US007762868B2

(12) United States Patent
Wong

(10) Patent No.: US 7,762,868 B2
(45) Date of Patent: Jul. 27, 2010

(54) WALL DESCENDING TOY WITH MOVEABLE FEATURES

(75) Inventor: Tak Ko Wong, Kwun Tong (HK)

(73) Assignee: T K Wong & Associates Limited, Hong Kong SAR (HK)

( * ) Notice: Subject to any disclaimer, the term of this patent is extended or adjusted under 35 U.S.C. 154(b) by 335 days.

(21) Appl. No.: 11/900,313

(22) Filed: Sep. 11, 2007

(65) Prior Publication Data

US 2008/0064294 A1 Mar. 13, 2008

(30) Foreign Application Priority Data

Sep. 12, 2006 (GB) ..... 0617981.6

(51) Int. Cl.
*A63H 18/14* (2006.01)
*A63H 17/26* (2006.01)

(52) U.S. Cl. ..... 446/445; 446/279; 446/466

(58) Field of Classification Search ..... 446/431, 446/445, 437, 439, 441, 465, 466, 469, 470, 446/279, 330–333, 356
See application file for complete search history.

(56) References Cited

U.S. PATENT DOCUMENTS

| | | | | |
|---|---|---|---|---|
| 4,654,018 | A * | 3/1987 | Farrington et al. | 446/38 |
| 5,525,090 | A * | 6/1996 | Halford et al. | 446/465 |
| 5,916,008 | A | 6/1999 | Wong | |
| 6,461,218 | B1 * | 10/2002 | Mullaney et al. | 446/330 |
| 6,790,119 | B1 * | 9/2004 | Chia | 446/158 |
| 6,793,026 | B1 | 9/2004 | De Fazio | |

FOREIGN PATENT DOCUMENTS

GB 2326353 A 6/1997

* cited by examiner

*Primary Examiner*—Kien T Nguyen
(74) *Attorney, Agent, or Firm*—Jackson Walker, LLP

(57) ABSTRACT

A wall descending toy has a housing and a moveable part. A sticky wheel is located with the housing to facilitate movement of the housing down an inclined or vertical surface. There is a mechanical link moveable with movement of the housing and which causes movement of the moveable part.

10 Claims, 7 Drawing Sheets

WALL DESCENDING TOY WITH MOVEABLE FEATURES

BACKGROUND TO THE INVENTION

1. Field of the Invention

The present invention relates to a wall descending toy. More particularly, although not exclusively, a wall descending toy with moveable features for enhancing the fun factor of the toy.

2. Background Information

Toys with moveable features are widely available. These toys are usually wheeled and the moveable features are mainly actuated by the propelling wheels when traveling on a horizontal surface. Also, these toys imitate moveable objects, for example, cars, insects, etc., and most of these moveable objects travel on vertical or sloped surfaces. The problem with these toys is that they can only travel on horizontal surfaces. By running the toy on a vertical or steeply sloped surface, it is likely to fall over and causes injuries to the person playing with the toy.

Attempts have been made to overcome the above problem. U.S. Pat. No. 5,916,008 and GB 2326353B disclosed a wall descending toy with retractable wheels having sticky peripheral which allows the toy to travel on a vertical surface without falling over. The toys may be in the form of cars, cartoon characters and so forth. However, these toys fail to imitate movements of the moveable features that propel the character. In other words, the fun factor of these toys is affected by poor representation.

OBJECT OF THE INVENTION

It is the object of the present invention to overcome or substantially ameliorate at least one of the above disadvantages and/or more generally to provide an improved wall descending toy, in particular a wall descending toy, which has moveable features actuated by propulsion of the toy.

SUMMARY OF THE INVENTION

According to the invention there is disclosed herein a wall descending toy with moveable parts comprising a housing having one or more moveable parts located thereon, a sticky wheel located with the housing for facilitating movement of the housing down an inclined or vertical surface, and a mechanical link moveable with or by movement of the housing down the inclined or vertical surface and which mechanical link causes movement of the moveable parts.

Preferably, the wall descending toy further comprises an actuating wheel rotatably mounted with the housing for rotation with or by movement of the housing down the inclined or vertical surface and engaging with the mechanical link to cause movement of the mechanical link.

Preferably, the mechanical link is a thin strip of material selected from a group comprising copolymer of Acrylonitile, Butadiene and Styrene.

Preferably, the mechanical link is integrally formed with the moveable parts.

Preferably, the actuating wheel includes a cylindrical body having first and second ends with a rim about each of the ends for engaging on the surface and a circumferential groove disposed about the cylindrical body for engagement with the mechanical link.

Preferably, the actuating wheel has pegs on the rimed edge of the first end of the cylindrical body.

Preferably, the actuating wheel includes a cylindrical body having first and second ends with rims about each of the ends for engaging on the surface and peps on the rimed edge of the first end of the cylindrical body for engagement with the mechanical link.

Preferably, the actuating wheel consists of ductile and resilient material selected from the group consisting Polyvinyl Chloride (PVC) and Thermoplastic Rubber (TPR).

Preferably, the actuating wheel has a first diameter and the sticky wheel has a second diameter wherein the diameter of the actuating wheel is not more than +/−20% of the diameter of the sticky wheel.

Preferably, the moveable parts are pivotally engaged to the housing.

Further aspect of the invention will be apparent from the following description which is given by way of example only.

BRIEF DESCRIPTION OF THE DRAWINGS

An embodiment of the present invention will now be described by way of example only and with reference to the accompanying drawings in which.

DESCRIPTION OF THE PREFERRED EMBODIMENT

The accompanying drawings depicted various embodiments of a wall descending toy along with various embodiments of an actuating wheel. Although specific examples are presented to illustrate the invention, it should be appreciated that this invention extends to other configurations.

Figure 1:
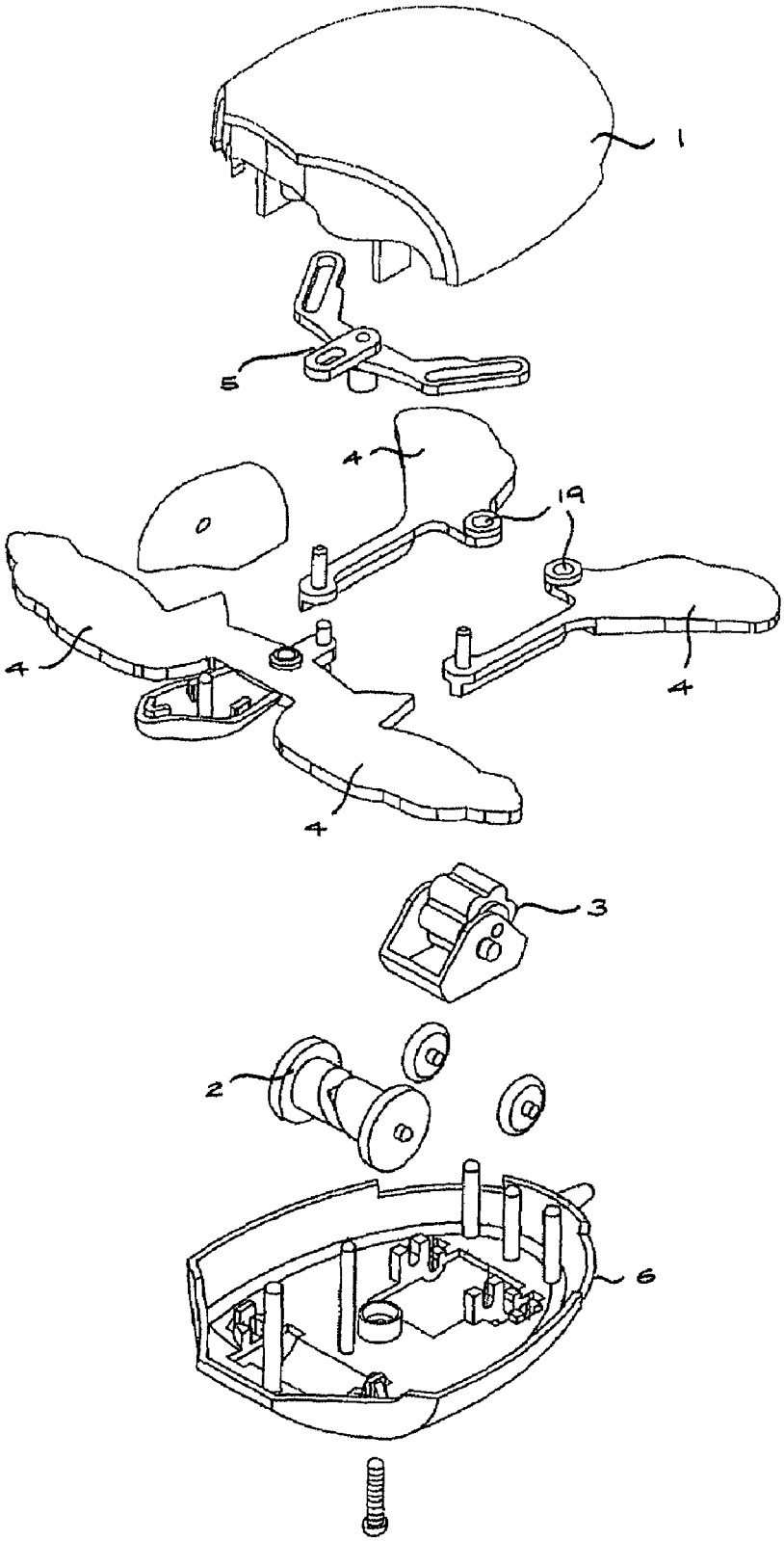
FIG. 1 is an exploded schematic depiction of the wall descending toy with moveable parts according to the invention.

Referring to FIG. 1, there is depicted a wall descending toy with moveable parts in the form of a turtle. The toy includes a housing 1 holding an actuating wheel 2, a sticky wheel 3, moveable parts 4 and a mechanical link 5. The sticky wheel 3 has an undulating sticky peripheral surface which allows the toy to travel down a vertical or steeply inclined surface. Suitable materials for the sticky surface 3 include a sticky gelatinous composition, such as a melt blend admixture of poly (styrene-ethylene-butylene-styrene) triblock copolymer and plasticising oils which form bonds with the wall surface to allow the toy to travel on a vertical or steeply inclined surface. The actuating wheel 2 is rotatably mounted with the housing 1 for rotating with the transfer of the toy on the surface. The actuating wheel 2 is engaged with the moveable parts 4 by one or more mechanical links 5. The moveable parts 4 are moveably engaged with the mechanical links 5 and pivotally engaged with the housing 1 at a pivot point 19. The mechanical links 5 is a thin strip made from a copolymer of Acrylonitile, Butadiene and Styrene. There can be one or more mechanical links 5 within a wall descending toy and each mechanical links 5 can be connected to one or more moveable parts 4.

Figure 2:
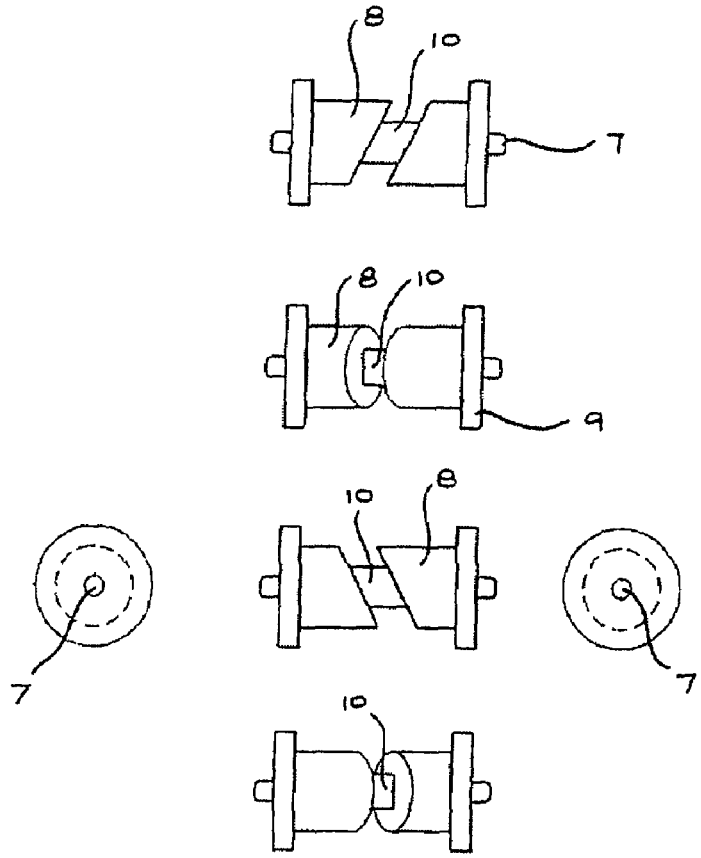
FIG. 2 is a schematic multiple views of a first embodiment of an actuating wheel according to the invention.
Figure 3:
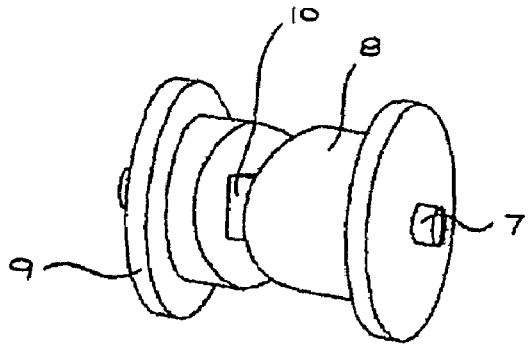
FIG. 3 is a schematic perspective view of the actuating wheel of FIG. 1.

FIGS. 2 and 3 depicted a first embodiment of the actuating wheel 2 having a rotary shaft 7 along which is a cylindrical body 8. The cylindrical body 8 has first and second end with rims 9 for rotating with the transfer of the toy on the surface. A circumferential groove 10 is disposed on the cylindrical body 8. The groove 10 provides an engagement point between the actuating wheel 2 and the mechanical link 5.

Figure 4:
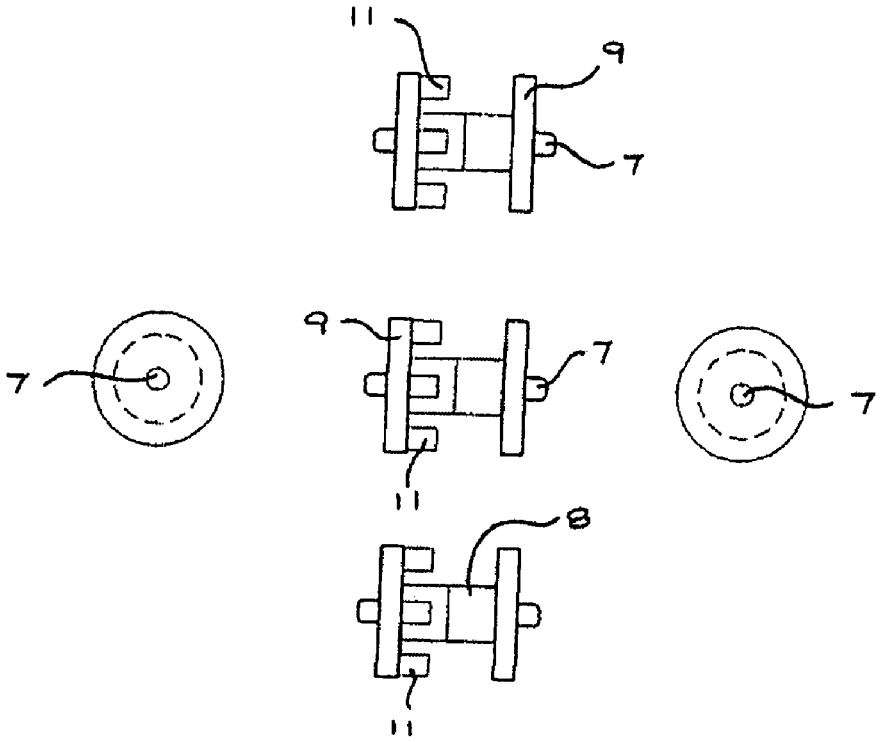
FIG. 4 is a schematic multiple views of a second embodiment of an actuating wheel according to the invention.
Figure 5:
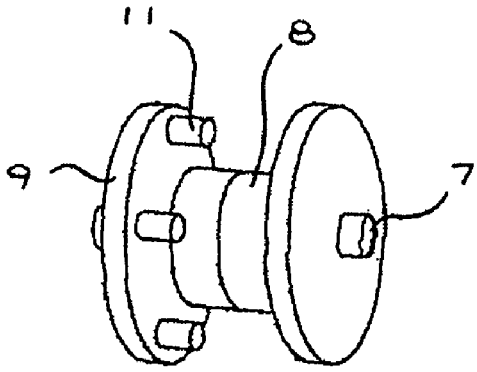
FIG. 5 is a schematic perspective view of the actuating wheel of FIG. 4.

FIGS. 4 and 5 shows a second embodiment of the actuating wheel 2. This wheel also has a rotary shaft 7 along which is a cylindrical body 8. The cylindrical body 8 has first and second end with rims 9 for rotating with the transfer of the toy. Pegs 11 are disposed on the rims 9 at the first end of the cylindrical body 8. These pegs 11 become the engagement points between the actuating wheel 2 and the mechanical links 5.

Figure 6:
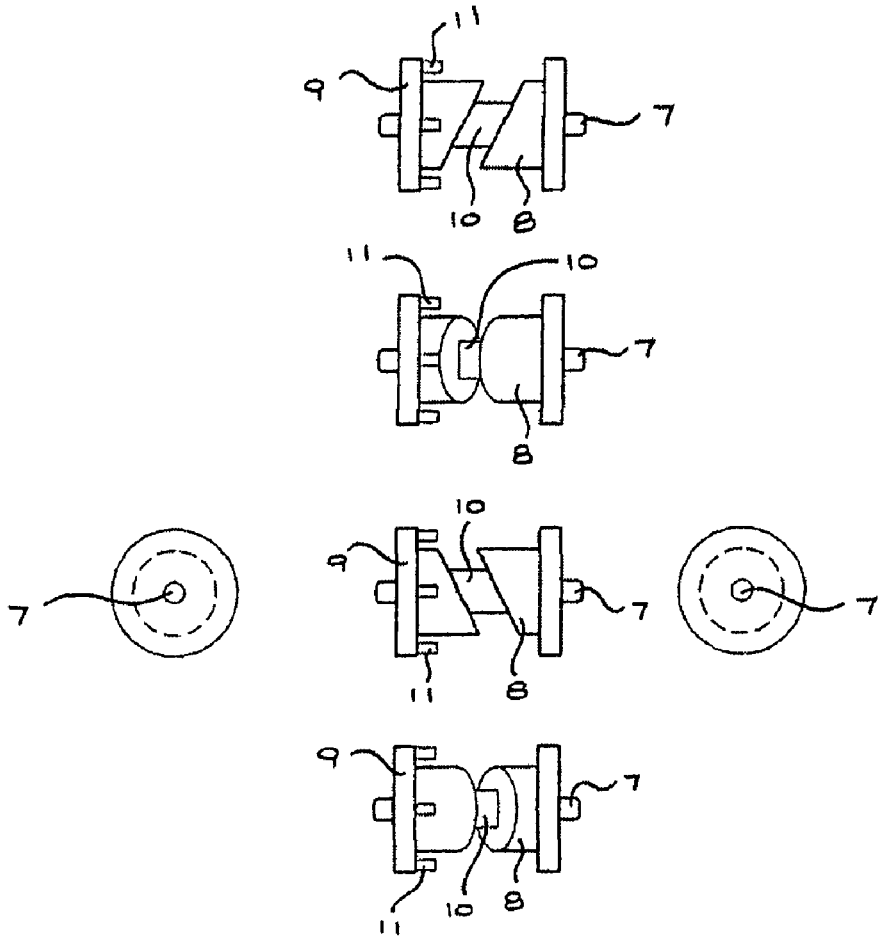
FIG. 6 is a schematic multiple view of a third embodiment of an actuating wheel according to the invention.
Figure 7:
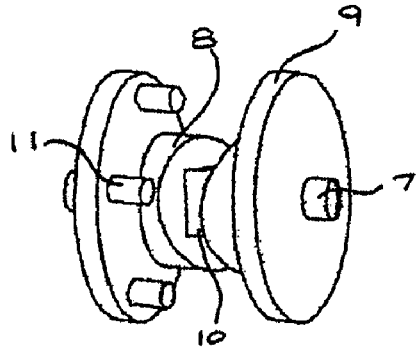
FIG. 7 is a schematic perspective view of the actuating wheel of FIG. 6.

As shown in FIGS. 6 and 7, the third embodiment of the actuating wheel 2 is a combination of the two actuating wheels as shown in FIGS. 2, 3, 4 and 5. The actuating wheel 2 of FIGS. 6 and 7 has a rotary shaft 7 along which is a cylindrical body 8. The cylindrical body 8 has first and second end with rims 9 for rotating with the transfer of the toy. A, circumferential groove 10 is provided at the cylindrical body 8 with pegs 11 disposed on the rims 9 at the first end of the cylindrical body 8. The groove 10 and the pegs 11 allow two mechanical links 5 to be engaged with the actuating wheel 2. Each mechanical link 5 is engaged with a different set of moveable parts 4 to bring about different movements in respective moveable parts 4 at the one time.

The actuating wheel 2 is made of ductile and resilient material selected from the group consisting Polyvinyl Chloride (PVC) and Thermoplastic Rubber (TPR). These materials are most suitable as they are of resilient nature and present a good adhesion surface. The size of the actuating wheel 2 is similar to that of the sticky wheel 3 and the diameter of the actuating wheel 2 should not be bigger or smaller than 20% of the diameter of the sticky wheel 3.

Figure 8:
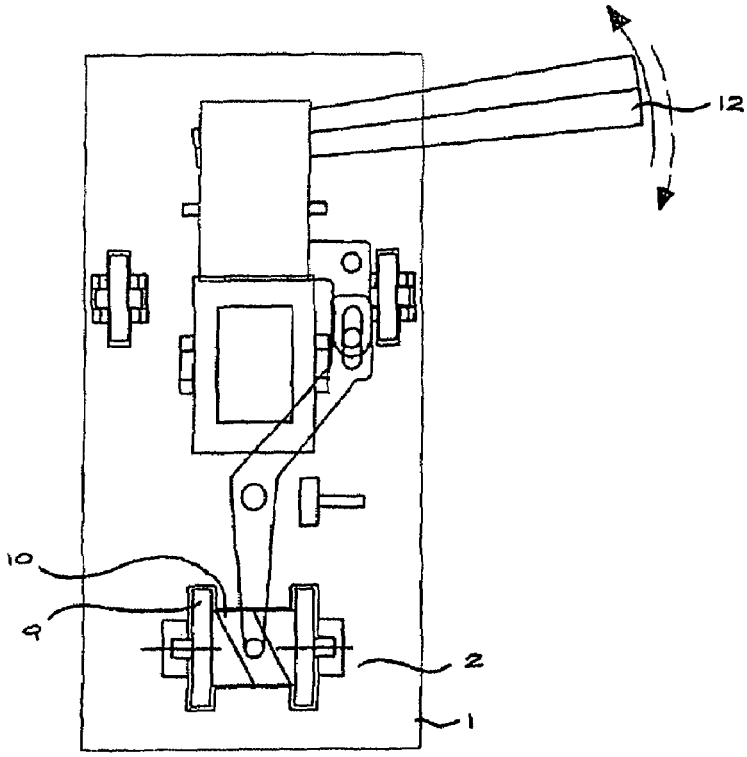
FIG. 8 is a schematic top sectional view of a first embodiment of a wall descending toy according to the invention.
Figure 9:
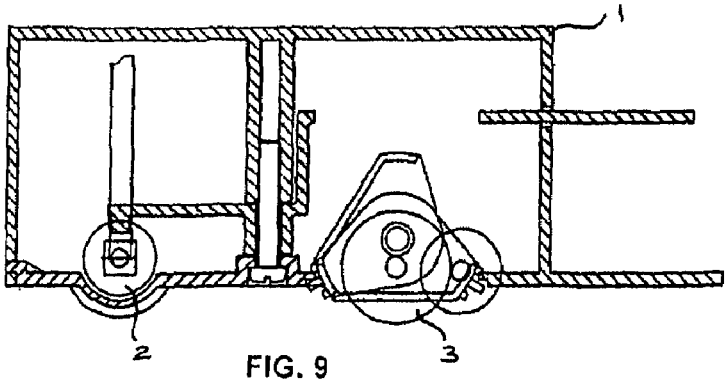
FIG. 9 is a schematic side sectional view of the wall descending toy of FIG. 8.
Figure 10:
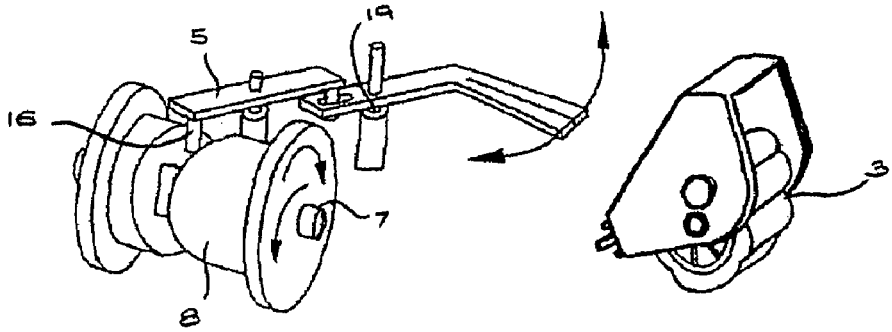
FIG. 10 is a schematic perspective view of an arrangement between an actuating wheel; a mechanical link and a sticky wheel of the wall descending toy of FIG. 8.

The movement of the moveable parts 4 is controlled by the configuration of the actuating wheel 2. Referring to FIGS. 8, 9 and 10 there is depicted a first embodiment of the wall descending toy with moveable parts in the form of a wall descending cup noodle with a pair of moveable chopsticks 12. The cup noodle includes the sticky wheel 3 and the actuating wheel 2 having a rotary shaft 7 along which is a substantially cylindrical body 8. The cylindrical body 8 has first and second end with rims 9 for supporting the actuating wheel 2 on the surface. A circumferential groove 10 is disposed on the cylindrical body 8 as shown in FIGS. 2 and 3. The mechanical links 5 has a protrusion 16 for engaging with the groove 10. When the cup noodle travels along a vertical wall, the rotation of the actuating wheel 2 actuates the reciprocal sideway movements of the mechanical links 5, which in turn guides the chopsticks 12 to pivot about a pivot point 19. In this way, the rotation of the actuation wheel 2 brings about the angular reciprocal motion of the chopsticks 12.

Figure 11:
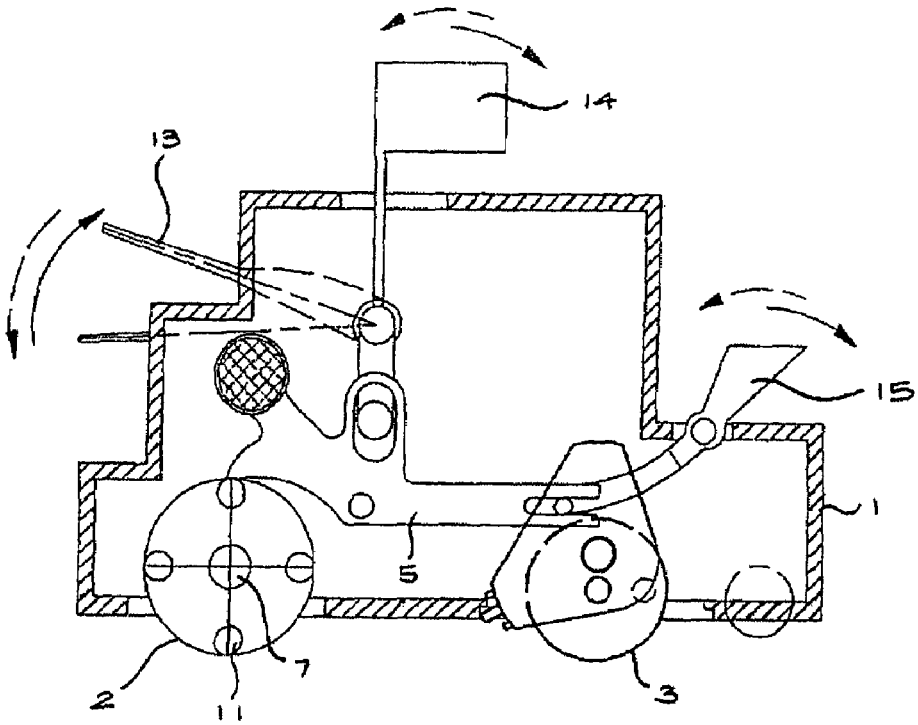
FIG. 11 is a schematic top sectional view of a second embodiment of a wall descending toy according to the invention, FIG. 12 a schematic perspective view of an arrangement between an actuating wheel, a mechanical link and a sticky wheel of the wall descending toy of FIG. 11.
Figure 12:
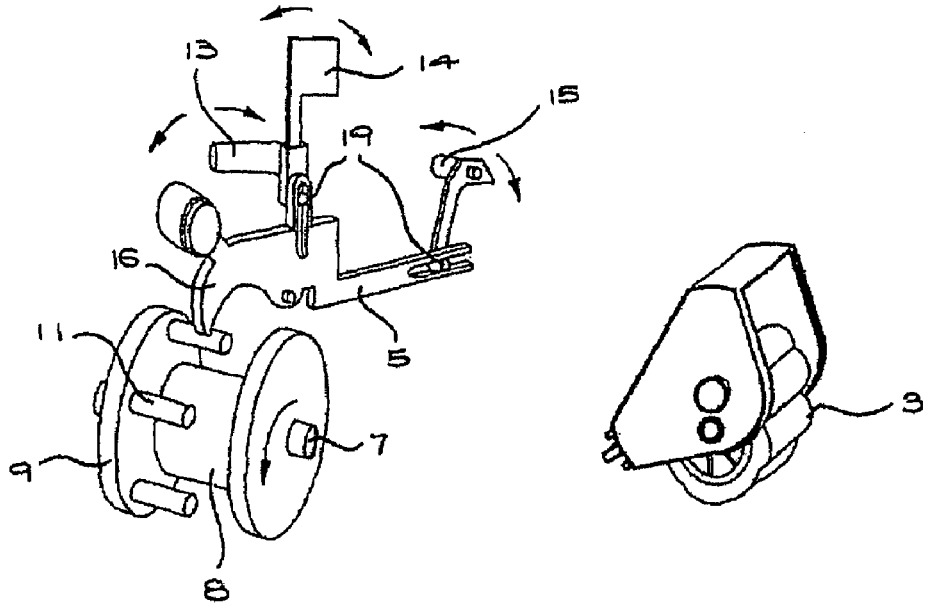

Referring to FIGS. 11 and 12, there is depicted a second embodiment of the wall descending toy in the form of a racing horse. The racing horse has three moveable parts 13, 14, and 15. These moveable parts 13, 14 and 15 are engaged with the actuating wheel 2 through a mechanical link 5. The actuating wheel 2 has a rotary shaft 7 along which is a cylindrical body 8 having first and second end with rims 9 for supporting the actuating wheel on the surface. Also, pegs 11 are disposed on the rims 9 at the first end of the cylindrical body 8 as shown in FIGS. 4 and 5. The clogs become the engagement points between the actuating wheel 2 and the protrusion 16 of the mechanical links 5. When the racing horse travels along a vertical surface, the actuating wheel 2 rotates and the first peg 11 will remain engaged with the protrusion 16 until it moves to a releasing point where the protrusion 16 is released to the next pegs 11(*a*) and bring about a reciprocal sideway movement of the mechanical links 5. The sideway movement of the mechanical links 5 will force the moveable parts 13, 14 and 15 to pivot over the pivot points 19 and bring about an angular reciprocal motion.

Figure 13:
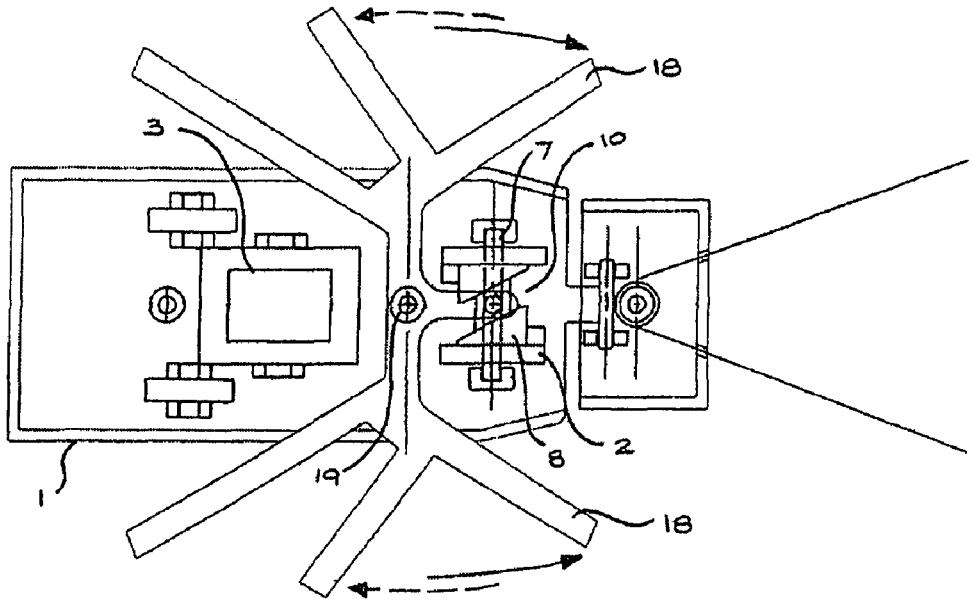
FIG. 13 is a schematic top sectional view of a third embodiment of a wall descending toy according to the invention.
Figure 14:
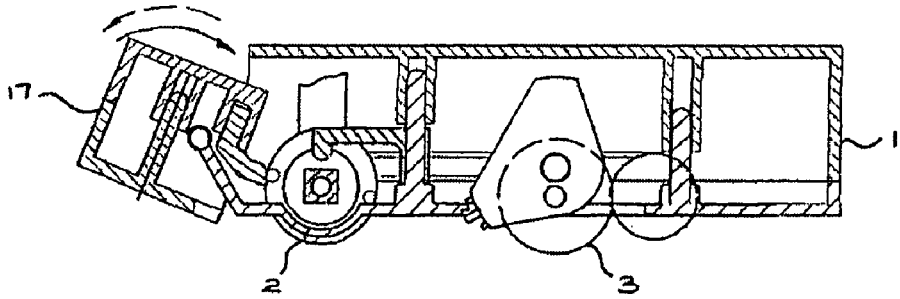
FIG. 14 is a schematic side sectional view of the wall descending toy of FIG. 13.
Figure 15:
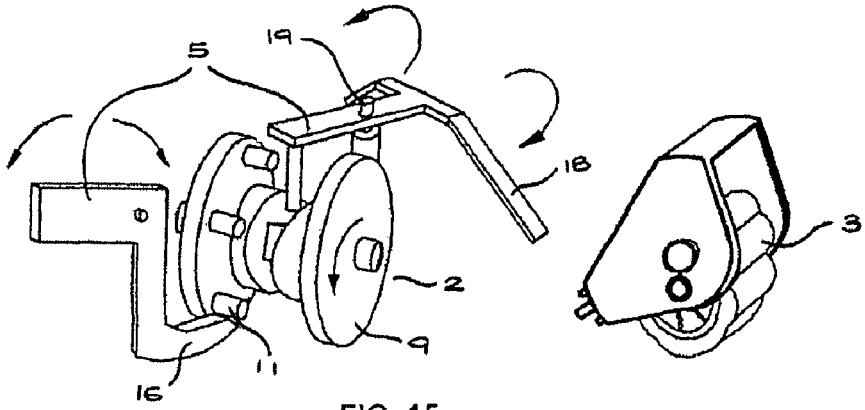
FIG. 15 is a schematic perspective view of an arrangement between an actuating wheel, mechanical links and a sticky wheel of the wall descending toy of FIG. 13.

Referring to FIGS. 13, 14 and 15, it shows a third embodiment of the wall descending toy in the form of a cockroach with moveable head 17 and legs 18. The cockroach includes an actuating wheel 2 having a rotary shaft 7 along which is a cylindrical body 8. The first and second ends of the cylindrical body have rims 9 rotating with the conveyance of the toy. An circumferential groove 10 is provided at the cylindrical body 8 with pegs 11 disposed on the rims 9 at the first end of the cylindrical body 8, as shown in FIGS. 6 and 7. The head 17 and the legs 18 are connected to the actuating wheel 2 separately by two mechanical links 5. The head 17 is connected to the pegs 11 of the actuating wheel 2 and the legs 18 are connected to the groove 10. The mechanical links 5 have protrusions 16 for engaging with the groove 10 and the pegs 11 and one of the mechanical links 5 is integrally formed with the moveable parts, namely the legs 18. When the cockroach travels along a vertical surface, the rotation of the actuating wheel 2 actuates a reciprocal sideway movement of the mechanical links 5 which forces the head 17 and legs 18 to pivot over the pivot points 19 which bring about an angular reciprocal motion.

It should be appreciated that modifications and alterations obvious to those skilled in the art are not to be considered as beyond the scope of the present invention. For example, in the preferred embodiments there is an actuating wheel engaged with the moveable parts to bring about their movement and a sticky wheel to allow wall walking. In an alternative embodiment, there can be a duel functional wheel which is both a sticky wheel and an actuating wheel.

The preferred embodiment has at most two mechanical links with specific shapes. In an alternative embodiment, there can be more than two mechanical links with various shapes to serve its purpose.

The preferred embodiment has a pivot point for engaging the moveable parts to the mechanical link. In an alternative embodiment, there need not be a pivot point.

The preferred embodiment there is two wheels, a sticky wheel and an actuating wheel. In an alternative embodiment, there can be more than two wheels.

What is claimed is:

1. A wall descending toy with moveable parts comprising: a housing having one or more moveable parts located thereon, a sticky wheel located with the housing for facilitating movement of the housing down an inclined or vertical surface, and a mechanical link moveable by movement of the housing down the inclined or vertical surface, the mechanical link causes movement of the moveable parts.

2. The wall descending toy of claim 1 further comprises an actuating wheel rotatably mounted with the housing for rotation by movement of the housing down the inclined or vertical surface and engaging with the mechanical link to move the mechanical link.

3. The wall descending toy of claim 2 wherein the actuating wheel includes a cylindrical body having first and second ends with a rim about each of the ends for engaging on the surface and a circumferential groove disposed about the cylindrical body for engagement with the mechanical link.

4. The wall descending toy of claim 3 wherein the actuating wheel has pegs on the rimed edge of the first end of the cylindrical body.

5. The wall descending toy of claim 2 wherein the actuating wheel includes a cylindrical body having first and second ends with rims about each of the ends for engaging on the surface and peps on the rimed edge of the first end of the cylindrical body for engagement with the mechanical link.

6. The wall descending toy of claim 2 wherein the actuating wheel consists of ductile and resilient material selected from the group consisting Polyvinyl Chloride (PVC) and Thermoplastic Rubber (TPR).

7. The wall descending toy of claim 1 wherein the mechanical link is a strip of material selected from a group comprising copolymer of Acrylonitile, Butadiene and Styrene.

8. The wall descending toy of claim 1 wherein the mechanical link is integrally formed with the moveable parts.

9. The wall descending toy of claim 1 wherein the actuating wheel has a first diameter and the sticky wheel has a second diameter wherein the diameter of the actuating wheel is not more than +/−20% of the diameter of the sticky wheel.

10. The wall descending toy of claim 1 wherein the moveable parts are pivotally engaged to the housing.

* * * * *